US005626490A

United States Patent [19]

Pitts et al.

[11] Patent Number: 5,626,490

[45] Date of Patent: May 6, 1997

[54] WIRE STUFFER CAP/STRAIN RELIEF FOR COMMUNICATION NETWORK OUTLET

[75] Inventors: Terry L. Pitts, Greensboro; Mitchell E. Miller, Clemmons, both of N.C.

[73] Assignee: The Whitaker Corporation, Wilmington, Del.

[21] Appl. No.: 533,598

[22] Filed: Sep. 25, 1995

[51] Int. Cl.[6] ..... H01R 4/24

[52] U.S. Cl. ..... 439/404; 439/417

[58] Field of Search ..... 439/395–405, 439/417–419

[56] References Cited

U.S. PATENT DOCUMENTS

| | | | |
|---|---|---|---|
| 4,891,018 | 1/1990 | Afflerbaugh et al. | 439/418 |
| 5,199,899 | 4/1993 | Ittah | 439/404 |
| 5,326,278 | 7/1994 | Logerot et al. | 439/404 |
| 5,540,600 | 7/1996 | Ivey | 439/417 |

*Primary Examiner*—David L. Pirlot

[57] ABSTRACT

Invention relates to an improved strain relief member for use in a communication network outlet utilizing a card-edge type connector. The connector typically may comprise a housing having a through cavity containing a plurality of axially arranged terminal contacts, where each contact is composed of a pair of blades having a slot therebetween for receiving a conductor normal to the slot. The contacts are exposed to the rear of the housing, and a card-receiving opening communicates with the through cavity from the front of the housing. The rear portion of the housing is generally of a rectangular cross section having a uniform predetermined height. The improved strain relief member, constructed to be press fit onto the rear portion, comprises a dielectric housing having a top wall, a bottom wall and a rear wall extending therebetween. Internally the top and bottom walls include at least a pair of opposing ribs and that the distance therebetween is slightly less than the predetermined height so as to provide a press fit engagement with the rear portion of the connector housing. As an optional feature, means in the form of a conductor engaging wall are provided in the strain relief member to facilitate its use in stuffing or terminating insulation wrapped conductors in the slots between respective blades.

6 Claims, 5 Drawing Sheets

WIRE STUFFER CAP/STRAIN RELIEF FOR COMMUNICATION NETWORK OUTLET

RELATED APPLICATION

This invention relates to an improvement to the communication network outlet disclosed in U.S. Ser. No. 08/378,122, filed Jan. 24, 1995, and assigned to the assignee hereof. Such co-pending application itself represents a further improvement to the communication network outlet taught in U.S. Pat. No. 4,756,695, hereafter '695, also assigned to the assignee hereof, where such co-pending application and patent are each incorporated herein by reference in their entirety.

BACKGROUND OF THE INVENTION

This invention is directed to a system for terminating and/or providing strain relief to plural conductors terminated by a technique known as insulation displacement in a communication network outlet.

Data communications networks, such as local area networks used in offices, campuses, and factories, require that a large amount of data communications wiring be deployed. Quite often the data communications equipment or data terminal equipment which is used in these networks can change during the life of the facility. However, the wiring installed in the facility can often be used with different types of equipment.

One data communications network interface assembly or data communications outlet assembly which can provide a flexible interface between the installed wiring and various types of communications equipment is disclosed in '695, noted above. A complementary interface device is disclosed in U.S. Pat. No. 4,986,779. The devices and assemblies disclosed therein each employ a molded plastic frame which can be mounted in a standard wall box or in a wiring closet patch panel assembly. Network wiring connectors and network connector receptacle inserts or adapters can be mounted in these frames to attach the installed wiring to a plug or connector on the communications equipment. The network wiring connectors provide a common interface to shielded twisted pair and unshielded twisted pair data wiring. The network connector receptacle inserts are matable with the network wiring connectors and a family of these inserts provide a number of different receptacles configurations to the data communications equipment.

The mounting frames provide multiple open-ended cavities in which multiple devices, even using different types of wiring, can be installed at a single location, such as in a standard wall box or in a wiring closet patch panel. These mounting frames are integrally molded plastic members with four side walls surrounding the open-ended cavities. Latches and device support members are integrally molded on the walls. The network wiring connector used in those configurations employ insulation displacement connector terminals to provide for simple field termination of data wires. The network wiring connectors edge card connectors with a forwardly facing printed circuit board mating interface, and the network connector receptacle inserts have a printed circuit board interface for mating with these edge card connectors. Thus the edge cards can be easily inserted and removed from their mating configuration with the wiring connector, from the mounting frame and from the assembly. The frame also included screw holes which permit the attachment of a cover to the assembly. The cover includes openings through which the receptacle interface is accessible. The mounting frame also can be plated to provide a shield for applications requiring the use of shielded cable.

In the communication network outlet of '695, there is disclosed a card edge connector having a card edge receiving slot along a first face, and a wire stuffing member for terminating plural conductors to complementary barrel-type contacts, such that the conductors exit the connector through a second face. While a great advance in the art, the communication network outlet of '695 patent required a stuffer member to be depressed into locking engagement with the housing of the edge connector in order to insert the individual conductors into the insulation displacement slots of the barrel-type contacts. In order to apply the requisite force, typically a vertically downwardly directed force, to depress the stuffer member into locking engagement with the housing of the edge connector, the housing of the edge connector had to be supported by a firm surface which prevented movement of the housing of the edge connector and the resulting misalignment of the conductors and the respective barrel-type contacts. Accordingly, the stuffer member had to be depressed into locking engagement with the housing of the edge connector prior to inserting the edge connector into the receiving cavity of the wall box, since the wall box will not necessarily provide a firm support surface or correct orientation during the application of the force necessary to depress the stuffer member.

This time consuming and complex system gave rise to a new generation of communication network outlets as more fully described in said co-pending application. Among other features, the system of the co-pending application replaced the card edge connector with a two-piece unit which included a 110 style wiring block arrangement for receiving and terminating the individual conductors. One advantage of this type of arrangement is its versatility in being readily terminated by hand tools. That is, conductors, typically part of a multi-conductor cable, can be individually inserted and terminated in the insulation displacement slots defined by the split beams of the contacts, such as by an impact tool. Common impact tools include those manufactured and sold by AT&T bearing product number D814 and by Krone bearing product number 6417-2-055-01.

Shortcomings of such a system are the fact that individual conductor termination is required, and as a result of the compactness of the system, the conductors must be severely bent placing considerable strain on the terminated conductors. The present invention offers a significant improvement thereto by providing a stuffer cap that can terminate multiple conductors more efficiently than the hand tools currently in use, while providing strain relief to the terminated conductors. These and other features will be apparent to those skilled in the art from reading these specifications, particularly when read in conjunction with the accompanying drawings.

BRIEF DESCRIPTION OF DRAWINGS

FIG. 3 is a sectional view taken along line 3—3 of FIG. 2.

SUMMARY OF THE INVENTION

This invention is primarily directed to an improved strain relief member for use in a communication network outlet utilizing a card-edge type connector. The connector typically may comprise a housing having a through cavity containing a plurality of axially arranged terminal contacts, where each contact is composed of a pair of blades having a slot therebetween for receiving a conductor normal to the slot. The contacts are exposed to the rear of the housings and a card-receiving opening communicates with the through cavity from the front of the housing. The rear portion of the housing is generally of a rectangular cross-section having a uniform predetermined height. The improved strain relief member, constructed to be press fit onto the rear portion; comprises a dielectric housing having a top wall, a bottom wall and a rear wall extending therebetween. Internally the top and bottom walls include at least a pair of opposing ribs, and that the distance therebetween is slightly less than the predetermined height so as to provide a press fit engagement with the rear portion of the connector housing. As an optional feature, means are provided in the strain relief member to facilitate its use in stuffing or terminating insulation wrapped conductors in the slots between respective blades.

DETAILED DESCRIPTION OF PREFERRED EMBODIMENT

This invention relates to a system for terminating and/or providing strain relief to plural conductors terminated at a remote end of a communication network outlet.

Figure 1:
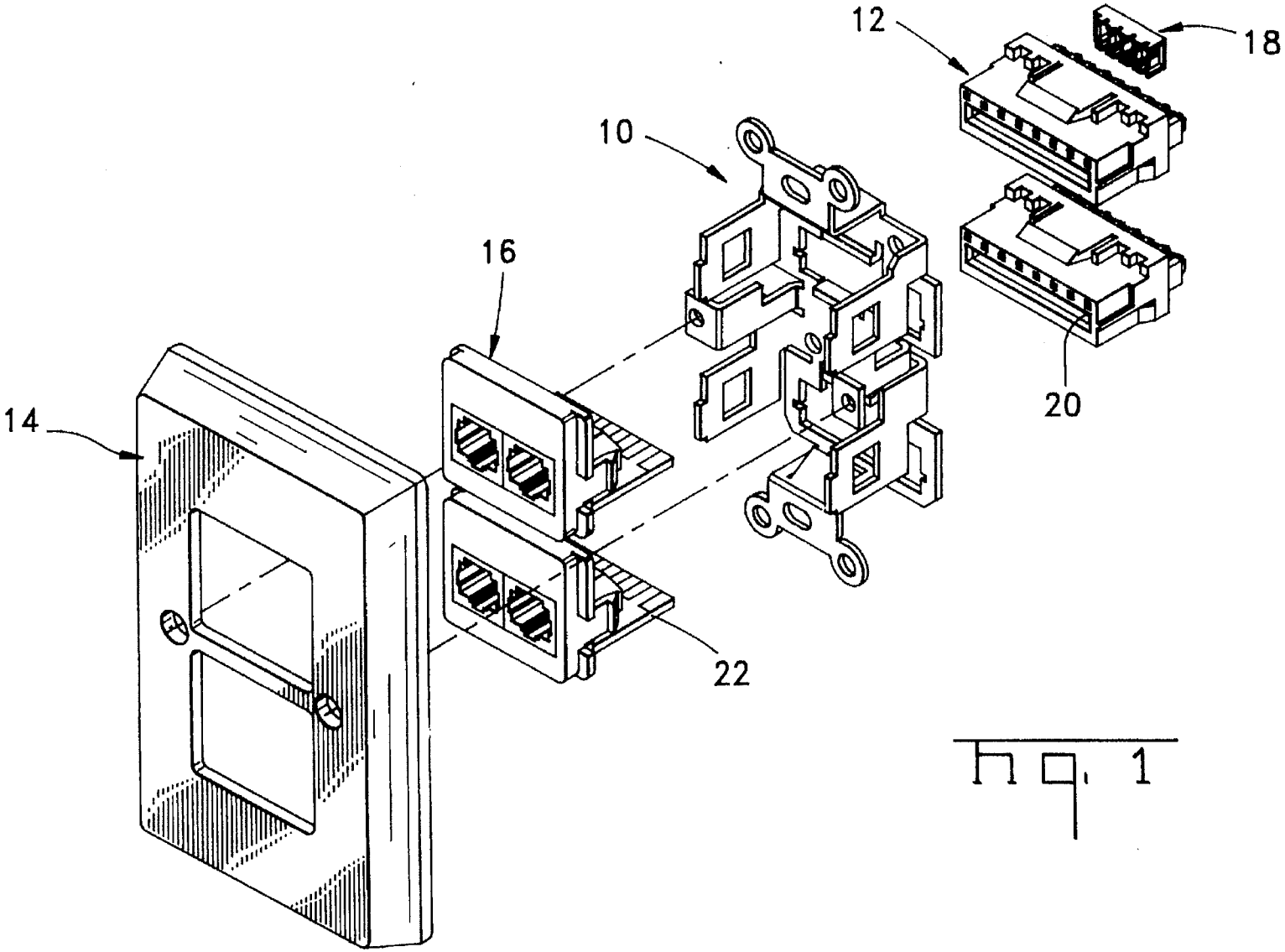
FIG. 1 is an exploded perspective view of an improved communication network outlet, including a stuffer cap/strain relief member, according to the present invention.

A typical communication network outlet, suitable for practicing this invention, is illustrated in an exploded fashion in FIG. 1. The network outlet assembly shown in the Figure is a modular assembly comprising a mounting frame 10, card edge connectors 12, a faceplate 14, two dual modular jack subassemblies 16, and a single stuffer member/strain relief member 18, where the latter is the improved feature of this invention. It should be noted, that while two dual modular jack subassemblies have been illustrated, such subassemblies may well be single port modular jacks, or data connectors, as known in the art, or even a combination thereof. With this understandings the preferred embodiment for the network outlet assembly serves as an interface point at which data communications equipment can be connected to the wiring in a local area network or other network of electrical components in an office, a factory, a laboratory or other facility. For a further discussion and features of network outlet assemblies, reference is made to the patent and application noted above, and to co-pending application (Attorney Docket 16120), filed Aug. 4, 1995, the contents of which are incorporated herein by reference.

These network outlet; assemblies provide a convenient way in which the wiring employed in a network can be attached to input and output interface connectors or receptacles or ports to which components such as desktop computers and workstations can be attached. Appropriate modular insert subassemblies are used in these outlet assemblies for interconnection to the physical media or wiring used in a particular installation. For example, a modular jack insert can be used with twisted wires, a coaxial insert with coaxial cable and a fiber optic connector with optical fiber cable. The appropriate insert subassembly is mounted on the mounting frame 10 and connected to the cable. The illustrated embodiment of the dual modular jack insert subassembly 16 is a printed circuit board subassembly that is connected to the cable wiring by a card edge connector 12. This outlet assembly is mounted in a wall box and a faceplate 14, having openings through which the connector on the insert subassembly is accessible, and is then attached to the mounting frame 10. These outlet assemblies are typically mounted in a standard wallbox, such as a standard NEMA wiring device box. The entire outlet assembly, excluding of course the faceplate, must be mounted in a standard 16 cu. in. single gang box. These commercially available outlet assemblies may also have two insert subassemblies mounted one above the other so that more than one device can be attached or so that more than one cable, cable branch, or type of cable or physical media can be accommodated.

Figure 7:
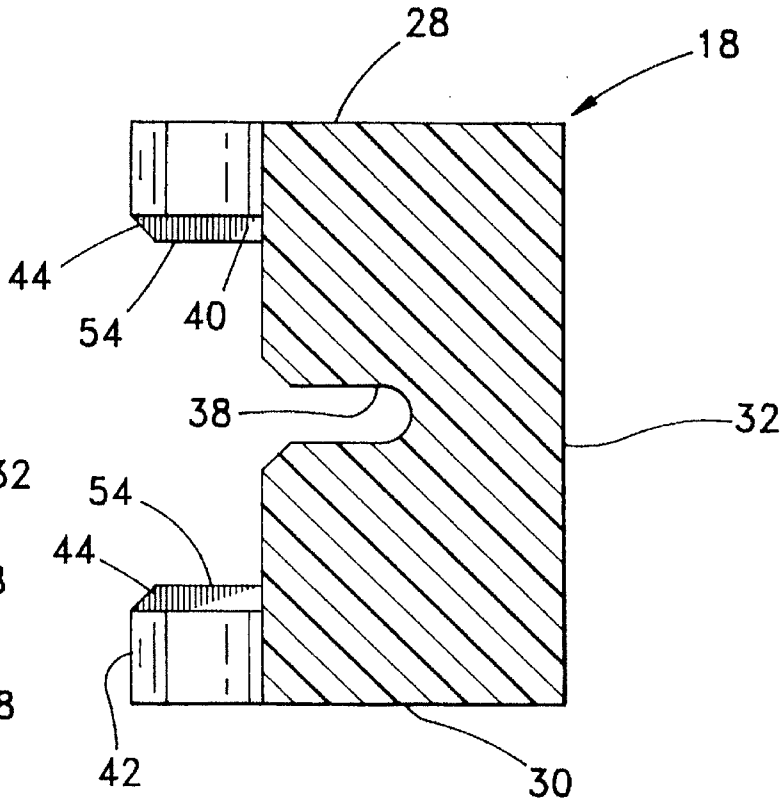
FIG. 7 is an enlarged, partial, vertical sectional view showing the applied or positioned stuffer cap/strain relief member of FIG. 6 to terminated conductors.

Though not illustrated in FIG. 1, the card edge connector 12 may comprise a two-part housing and includes an internal through cavity 20 for receiving the printed circuit board 22 of the insert assembly 16. As more clearly described and illustrated in co-pending application ('122), the connector 12 includes a plurality of contact terminals 24, see FIGS. 6–8. The contact terminals are positioned at least partially within the cavity 20 defined within the housing of the card edge connector 12. Each contact terminal has a resilient contact portion for contacting a conductive trace defined on a printed circuit board 22 which is inserted into the cavity from the front surface of the connector housing. Each contact terminal also includes an insulation displacement contact portion at the rear. The insulation displacement contact portion includes a pair of opposed blade or split beam portions to define conductor receiving slot therebetween, as known in the art. That is, the respective contact portions are planarly arranged horizontally of the connector housing, and accessible for termination from the rear. In this arrangement, as will be seen from an examination of FIGS. 6–8, the insulation wrapped conductors are vertically oriented to a respective individual contact terminal 24, then terminated thereto by a technique known in the art as insulation displacement. By the use of this type of connector, with the contact terminals 24 arrayed along the rear thereof, the conductors may be individually terminated, such as by a hand tool, or plural conductors terminated by the use of the stuffer cap/strain relief member 18, as hereafter explained. Even if individually terminated, such as by an impact tool, the stuffer cap/strain relief member 18 should still be used to function as a strain relief. In any case, for further understanding of the practice of this invention, two common impact tools include those manufactured and sold by AT&T, bearing product number D814, and by Krone, bearing product number 6417-2-055-01.

Figure 2:
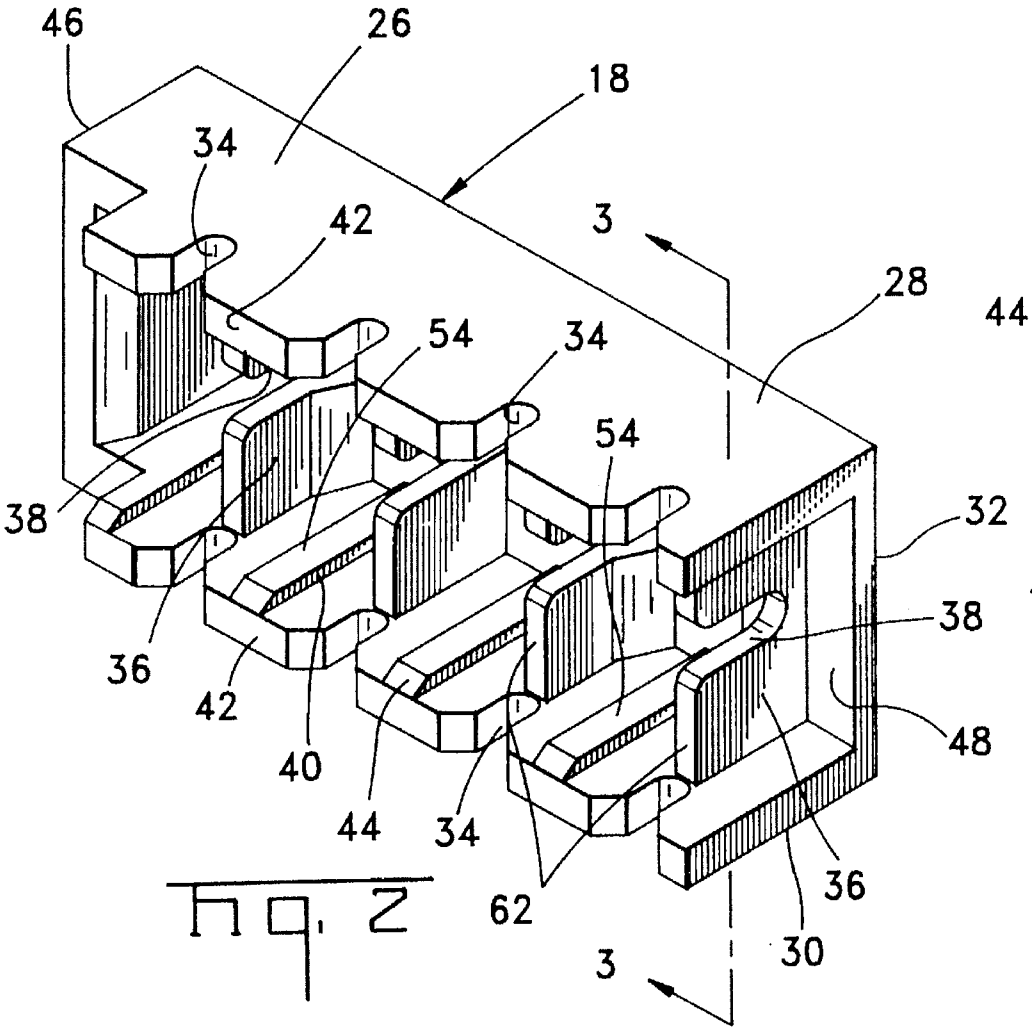
FIG. 2 is a perspective view of an exemplary stuffer cap/strain relief member of this invention, where the number of conductors to be accommodated thereby will vary directly with the number of conductor slots available.
Figure 5:
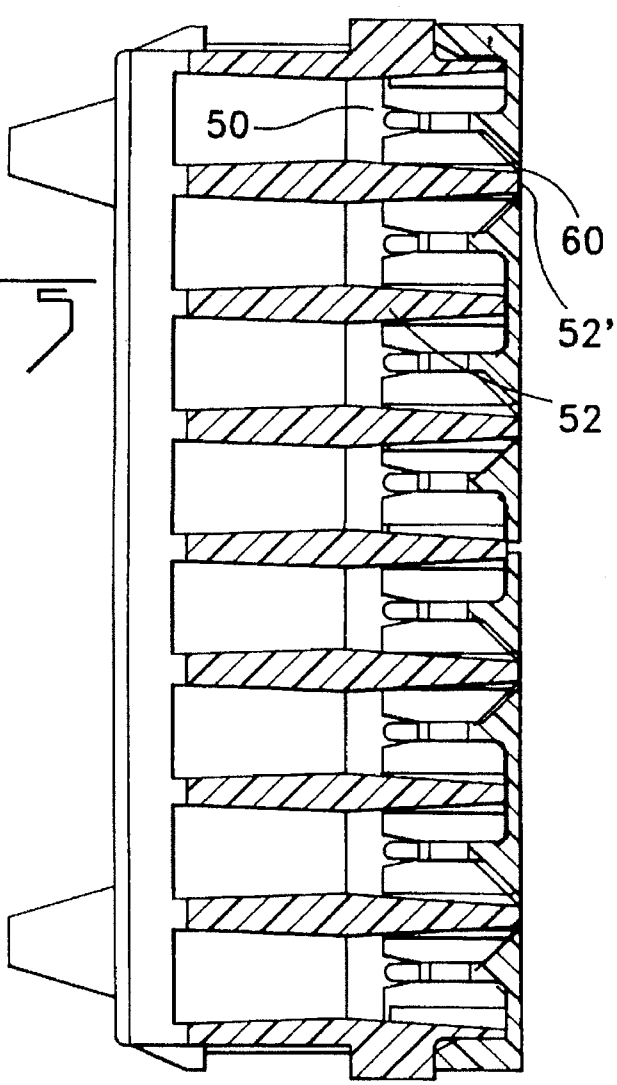
FIG. 5 is a horizontal sectional view of the engaged components of FIG. 4.
Figure 4:
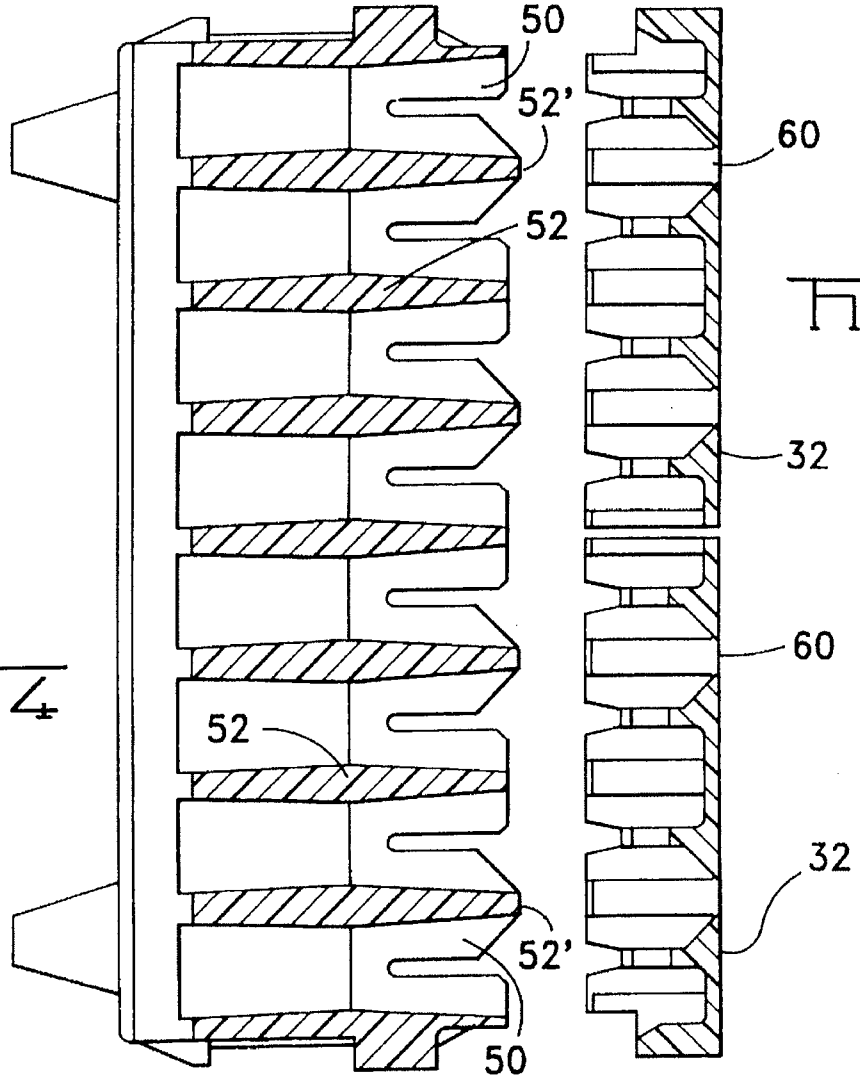
FIG. 4 is a horizontal sectional view showing the rear of a card edge type connector, and the stuffer cap/strain relief member of this invention poised for engagement with the card edge connector.

Turning now to the stuffer cap/strain relief member 18, as illustrated in FIGS. 2 and 3, such member comprises a dielectric housing 26 having top and bottom walls 28, 30, respectively, and a rear wall 32 integrally joined therebetween. The respective top and bottom walls are provided with a series of aligned conductor receiving slots 34. In the particular embodiment of FIG. 2, the stuffer cap/strain relief member 18 is designed to receive four conductors. For a typical eight position connector, two such members would be positioned side-by-side, as illustrated in FIG. 4. Thus, it should be apparent that a single or plural stuffer cap/strain relief member 18 may be used with a single connector. In any case, continuing with the structure of the stuffer cap/strain relief member 18, it will be noted that plural partition walls 36 are provided, one such wall extending internally between each set or pair of partition walls 36. Each such partition wall 36 further includes an intermediate slot 38, the function of which will be apparent hereinafter. Between the respective walls 36, upper and lower ribs 40 extend from the front edge 42 of the respective top and bottom walls 28,30 toward and in contact with the rear wall 32. The respective ribs 40 are tapered along the ends 44 at the front edge 42 to facilitate press fitting of the stuffer cap/strain relief member 18 onto the card edge connector, as will be explained hereinafter. Finally, as noted in FIGS. 2, 4 and 5, only one end 46 is closed, as it is intended in this preferred embodiment that a companion stuffer cap/strain relief member 18 would be used. That is, a pair of such members would be side-by-side with the respective open ends 48 adjacent one another, with the closed ends 46 on the outside, see FIG. 4. However, it should be apparent that if more than two stuffer cap/strain relief members 18 are used, the internal members would be open on both ends. Conversely, if only a single member were used to handle all conductors, then both ends would be closed. However, it is preferred that no more than two such members be used on a single connector as the closed end 46 provides some additional structural integrity to the stuffer cap/strain relief member 18.

To understand the relationship between the stuffer cap/strain relief member 18 and the card-edge connector 12, it is necessary to shift attention to the latter component. As more fully described in co-pending application, U.S. Ser. No. 08/378,122, the card edge connector 12 may comprise a two-piece housing, where the rear thereof, see FIG. 4, is defined by plural slots 50 in communication with the through cavity 20. The slots 50 are defined by essentially parallel walls or partitions 52. That is, adjacent walls define a single contact receiving slot. This array of walls, including the end walls, have a generally rectangular appearance so as to be received within the generally rectangularly shaped stuffer cap/strain relief member 18. To facilitate this engagement, the height of walls 52 are of a predetermined dimensions and the vertical distance between the rib surfaces 54 (stuffer cap/strain relief member 18) is slightly less than said predetermined height. By the dimensional differences and the compliant nature of the dielectric material, i.e. plastic, a proper press fit engagement may be achieved.

It will be noted further in FIG. 4 that alternate walls 52' are axially longer than adjacent walls 52. It will be recalled that it is contemplated by this invention that termination of the conductors may be effected individually by conventional hand tools, or by plural termination by means of the stuffer cap/strain relief member 18. In any case, the walls 52,52' are dimensionally different to ease the manual lacing of the conductors into a pretermination positions, the pretermination position shown ill FIG. 6. Also, to ensure full seating of the stuffer cap/strain relief member 18 onto the rear of the card-edge connector 12, aligned holes 60 may be provided along the rear wall 32 to receive the ends of walls 52'.

Figures 6, 7:
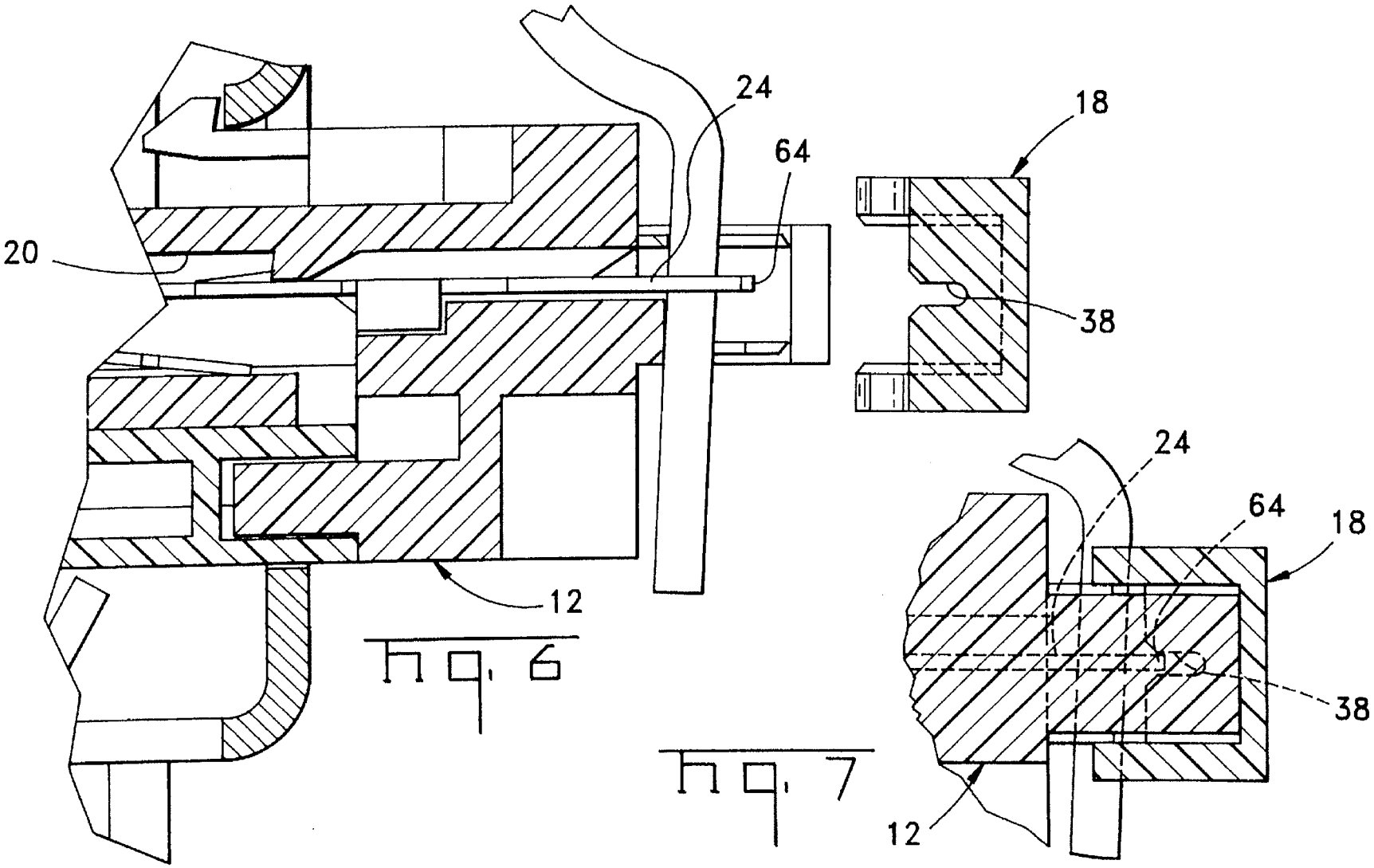
FIG. 6 is an enlarged, partial vertical sectional view illustrating a pre-application position of the stuffer cap/strain relief member of this invention, poised for engagement with a card edge type connector.
Figure 8:
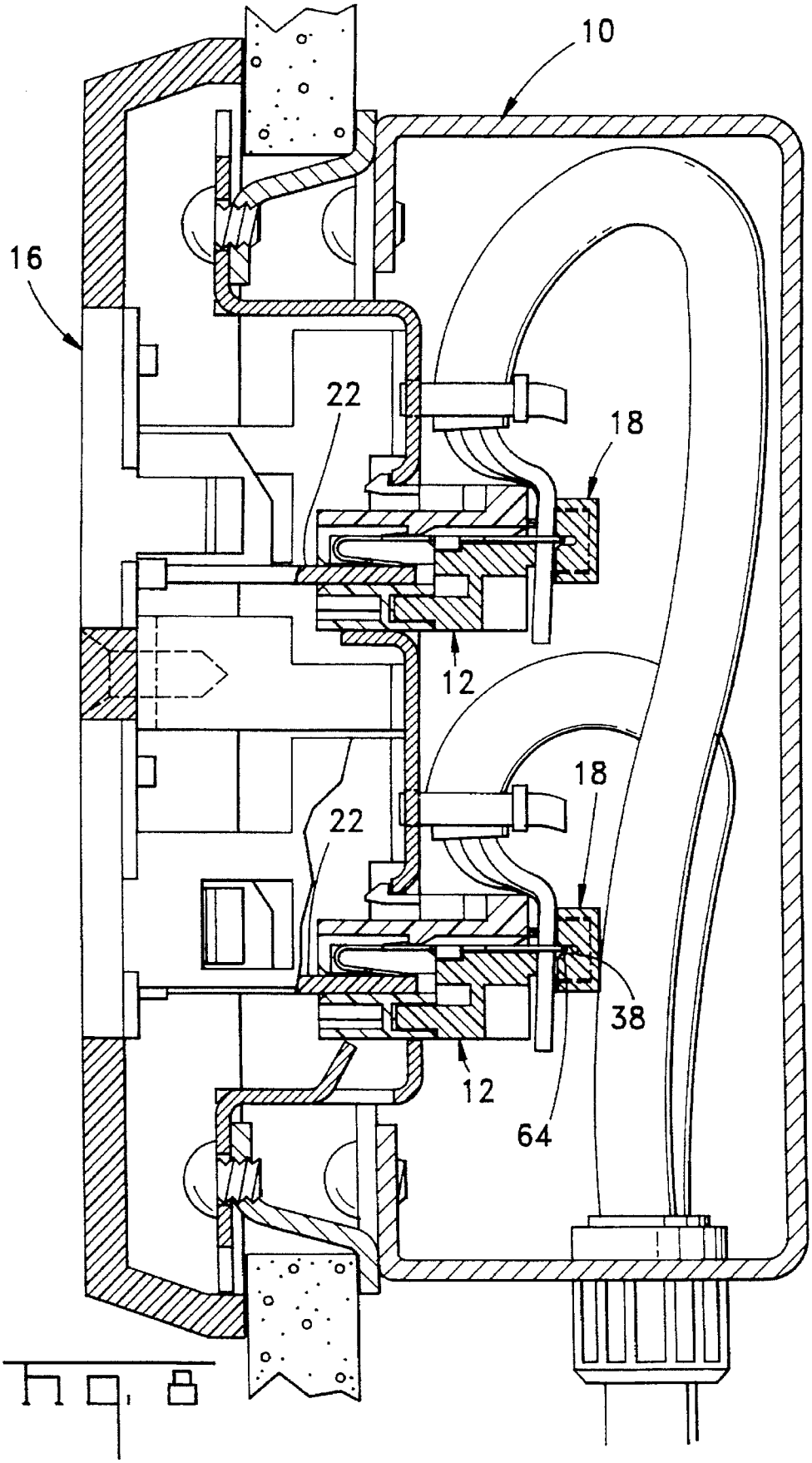
FIG. 8 is a vertical cross-sectional view of an assembled communication network outlet mounted in a wall, where such outlet incorporates a stuffer cap/strain relief member according to this invention.

For mass or plural conductor termination by the stuffer cap/strain relief member 18, the facing edge 62 of the partition walls aligned with the conductor slots 34, functions to push the conductor into the slotted beam contact from the pretermination position (FIG. 6). Since, however, the conductor is pushed past the contact end 64 (see FIG. 6), the intermediate slot 38 was provided to receive the contact end 64, and in fact to finally position itself between the ends of the contact beams. In either case, whether individual or mass conductor termination, the stuffer cap/strain relief member 18 is press fit onto the rear of the card-edge connector and snugly thereagainst providing strain relief to the severely bent conductors, see FIGS. 6 to 8.

We claim:

1. In a communication network outlet utilizing a card-edge type connector, where said connector comprises a housing having a through cavity containing a plurality of axially arranged terminal contacts, and each said contact is composed of a pair of blades having a slot therebetween for receiving a respective conductor normal to said slot, said contacts being exposed to the rear of said housing, and a card-receiving opening communicating with said through cavity from the front of said housing, where the rear portion of said housing is generally of a rectangular cross-section having a uniform predetermined heights the improvement comprising in combination therewith the provision of a strain relief member press fit onto said rear portion, said strain relief member comprising a dielectric housing having a top wall, a bottom wall and a rear wall extending therebetween, wherein said top and bottom walls include plural aligned slots for receiving said respective conductor in an opposed pair of said slots, wherein said housing includes a recessed wall extending between said top and bottom walls and aligned with said opposed pair of said slots for urging said respective conductor between said blades of said contact when said strain relief member is installed on said rear portion of said connector, wherein a height of said recessed wall between said top and bottom walls is greater than said predetermined height, where internally said top and bottom walls include at least a pair of opposing ribs, and a distance between said ribs is slightly less than said predetermined height so as to provide a press fit engagement with said rear portion of said connector housing.

2. The improved communication network outlet system according to claim 1, wherein each said recessed wall further includes a laterally extending slot to provide clearance for a respective said terminal contact.

3. The improved communication network outlet system according to claim 1, wherein said strain relief member includes at least one end wall connected to said top, bottom and rear walls.

4. The improved communication network outlet system according to claim 1, wherein said rear portion of said connector housing includes plural walls arranged to separate respective terminal contacts.

5. The improved communication network outlet system according to claim 4, wherein the height of said walls is equal to said predetermined height.

6. The improved communication network outlet system according to claim 5, wherein respective pairs of said opposing ribs engage corresponding ones of said connector housing walls.

* * * * *